US006643981B2

(12) United States Patent
Pina et al.

(10) Patent No.: US 6,643,981 B2
(45) Date of Patent: Nov. 11, 2003

(54) FORM ASSEMBLY FOR FORMING AN EAVE, A ROOF SLAB, AND A PERIMETER BEAM IN A MONOLITHIC STRUCTURE

(76) Inventors: Evelio Pina, No. 57 San Jose St., Apt. 201, San Juan, PR (US) 00901; Nestor Hernandez, No. 5 La Picua St., San Demetrio, Vega Baja, PR (US) 00694

( * ) Notice: Subject to any disclaimer, the term of this patent is extended or adjusted under 35 U.S.C. 154(b) by 17 days.

(21) Appl. No.: 09/931,904

(22) Filed: Aug. 20, 2001

(65) Prior Publication Data

US 2003/0033759 A1 Feb. 20, 2003

(51) Int. Cl.[7] ..... E04B 7/04

(52) U.S. Cl. ..... 52/91.2; 52/90.2; 52/745.06; 52/93.2; 249/27; 249/28

(58) Field of Search ..... 52/94, 90.1, 90.2, 52/91.1, 91.2, 79.11, 79.14, 742.14, 745.06, 92.1, 93.1, 93.2, 81.6; 249/23, 26, 27, 28, 210

(56) References Cited

U.S. PATENT DOCUMENTS

| | | | | |
|---|---|---|---|---|
| 2,039,183 A | | 4/1936 | Nagel | 52/602 |
| 2,139,623 A | | 12/1938 | Marston | 52/91.3 |
| 3,405,903 A | * | 10/1968 | Sullivan | 249/28 |
| 3,490,729 A | | 1/1970 | Luce et al. | 249/27 |
| 3,630,479 A | * | 12/1971 | Sullivan | 249/19 |
| 3,638,371 A | | 2/1972 | Liska | 52/91 |
| 3,693,927 A | | 9/1972 | Jennings | 249/11 |
| 3,847,341 A | | 11/1974 | Stickler, Jr. | 249/27 |
| 3,847,521 A | * | 11/1974 | Sticker, Jr. | 425/62 |
| 3,898,776 A | | 8/1975 | Cox et al. | 52/79 |
| 3,999,338 A | | 12/1976 | Behan, Jr. et al. | 52/92 |
| 4,047,357 A | | 9/1977 | Mulholland et al. | 52/90 |
| 4,211,043 A | | 7/1980 | Coday | 52/79.1 |
| 4,214,408 A | * | 7/1980 | Rich, Jr. | 52/79.1 |
| 4,426,060 A | | 1/1984 | Csont | 249/13 |
| 4,759,160 A | | 7/1988 | Fischer | 52/91 |
| 4,909,001 A | | 3/1990 | Gonzalez Espinosa de Los Monteros | 52/90 |
| 4,982,545 A | | 1/1991 | Stromback | 52/639 |
| 6,101,779 A | | 8/2000 | Davenport | 52/602 |
| 6,119,417 A | | 9/2000 | Valverde et al. | 52/223.7 |

* cited by examiner

*Primary Examiner*—Carl D. Friedman
*Assistant Examiner*—Naoko Slack
(74) *Attorney, Agent, or Firm*—Robert E. Bushnell, Esq.

(57) ABSTRACT

A form assembly for forming a roof slab, an eave, and a peripheral beam in a monolithic structure is provided. The form assembly is detachably attached to upright columns of a housing frame structure and includes an eave formwork and a peripheral formwork. The eave formwork is mounted on the upright columns while the peripheral formwork is disposed between columns to be coupled to the eave formwork. The peripheral beam is formed between the eave and the roof slab and encloses a portion of top beams of the housing frame structure.

27 Claims, 13 Drawing Sheets

FORM ASSEMBLY FOR FORMING AN EAVE, A ROOF SLAB, AND A PERIMETER BEAM IN A MONOLITHIC STRUCTURE

BACKGROUND OF THE INVENTION

1. Field of the Invention

The present invention relates to a form assembly for forming a roof slab, an eave, and a peripheral beam in a monolithic structure, and more particularly, to a form assembly mounted on upright walls of a housing frame for simultaneously forming the roof slab with the eave and the peripheral beam on the housing frame.

2. Description of the Background Art

A precast concrete roof slab is coupled to walls of a housing frame in order to build a concrete house. Although the precast concrete roof slab is simple in its construction, various parts, however, are needed when the precast concrete roof slab is coupled to the walls of the housing frame. Moreover, since the precast concrete roof slab is manufactured in a different location from the concrete house, it is very inconvenient to transfer the precast concrete roof slab to the location for the concrete house and to position the precast concrete roof slab onto the walls of the housing frame.

Otherwise, a concrete roof slab is formed with walls in a monolithic structure on a floor for building the concrete house. However, a complicated form structure is needed to build the monolithic structure of the concrete roof slab and the walls on the floor of the concrete house. Therefore, I have noticed that the conventional methods are not enough to provide a convenient and simple form structure in order to build a concrete house.

SUMMARY OF THE INVENTION

It is an object of the present invention to provide an improved form assembly able to provide a simple and convenient form structure for forming a roof slab with an eave and a peripheral beam in a monolithic structure.

It is another object to provide a form assembly able to reduce construction time for forming a roof slab, an eave, and a peripheral beam on a housing frame structure.

It is yet another object to provide a form assembly able to form a monolithic roof slab preventing water leakage.

It is still another object to provide a form assembly capable of being detachably attached to upright walls of a housing frame structure to form a monolithic roof slab on the housing frame structure.

It is a further object to provide a form assembly able to provide a monolithic roof slab with a peripheral beam supporting the monolithic roof slab and an eave downwardly extended from the monolithic roof slab.

It is also an object to provide a form assembly able to form a peripheral beam enclosing an end portion of a housing frame structure for giving strength to a monolithic roof and eave structure.

These and other objects may be achieved by providing a form assembly attached to a housing frame structure in order to form a roof slab, an eave, and a peripheral beam in a monolithic structure. The housing frame structure includes pairs of upright columns, horizontal beams anchored on the upright columns, top beams placed on the horizontal beams, and a roof deck placed on the top beams as a roof formwork.

The form assembly includes an eave formwork attached to the upright columns to form the eave, the roof formwork of the roof deck to form a concrete roof slab, and a peripheral formwork disposed between the upright columns to be coupled both the eave formwork and the roof deck to form a peripheral beam which is disposed between the roof slab and the eave. The peripheral beam is placed on horizontal beams or on the upright column and encloses end portions of the top beams and the horizontal beams to support the eave and the roof slab. Covers having a plurality of holes are attached to the upper portions of the eave formwork and side plates in order to provide spaces into which the concrete is poured through the holes or a gap between the covers. The form assembly is detachably attached to the upright columns of a housing frame structure and includes an eave formwork and a peripheral formwork. The eave formwork is mounted on the upright columns while the peripheral formwork is disposed between columns to be coupled to the eave formwork. The peripheral beam is supported by the upright columns.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
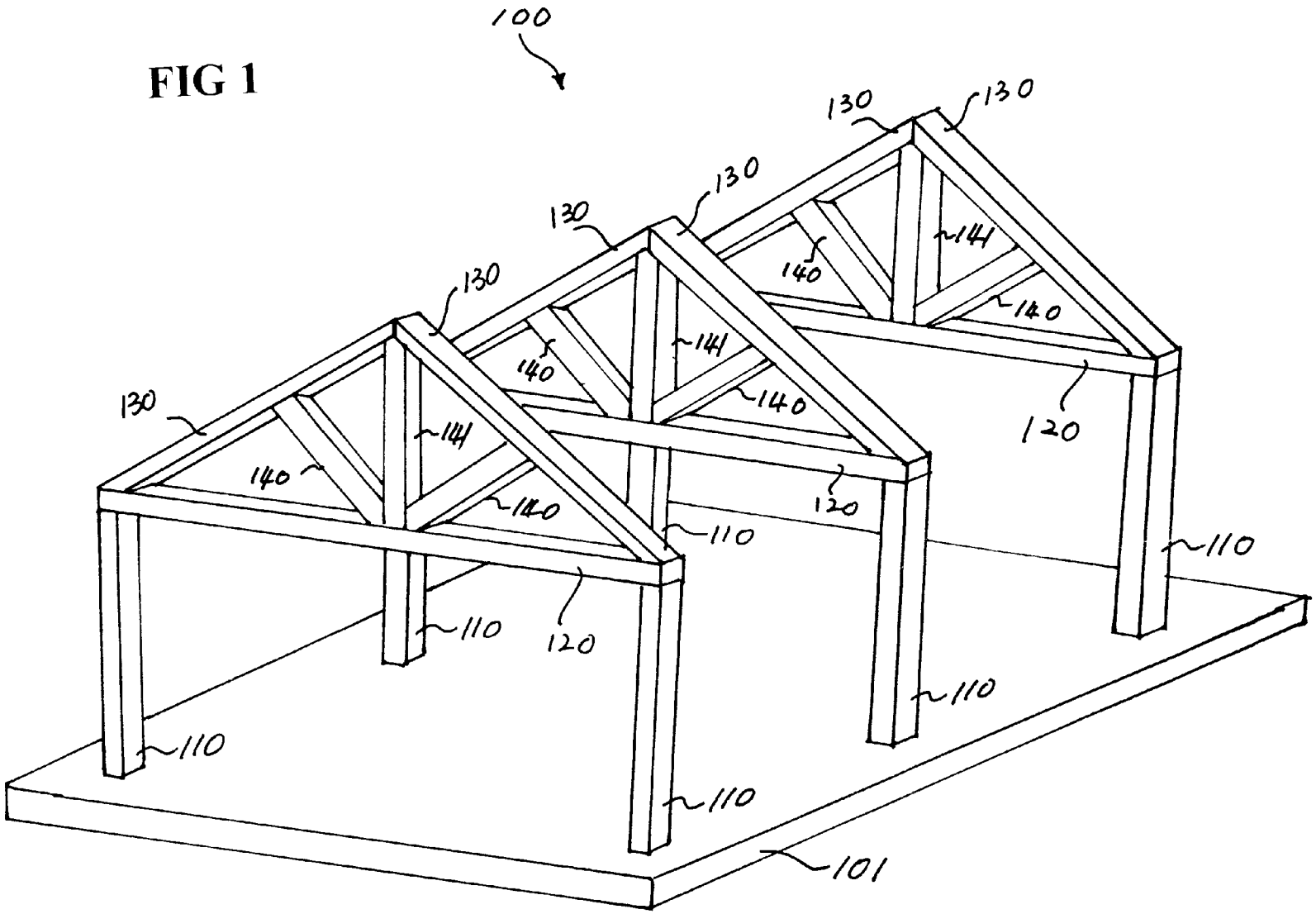
FIG. 1 is a perspective view of a housing frame structure constructed according to the principle of the present invention.

Turning now to the drawings, FIG. 1 illustrates a housing frame structure 100 built on a floor 101 for building a house. Pairs of upright columns 110 are spaced apart from each other and vertically anchored on floor 101 at the periphery of the house at a predetermined span. A horizontal beam 120 rests on top surfaces of each pair of columns 110, and two sloped top beams 130 are obliquely installed over each horizontal beam 120. Lower ends of sloped top beams 130 rest on a corresponding end portion of horizontal beam 120 while upper ends of sloped top beams 130 raised from horizontal beam 120 by a fixed distance meet each other in order to form a desired roof shape of housing frame structure 100. Concrete blocks or trusses may be used for top beams 130, horizontal beams 120, and upright columns 110. A space provided between sloped top beams 130 and horizontal beams 120 may be used as an attic.

Figure 2:
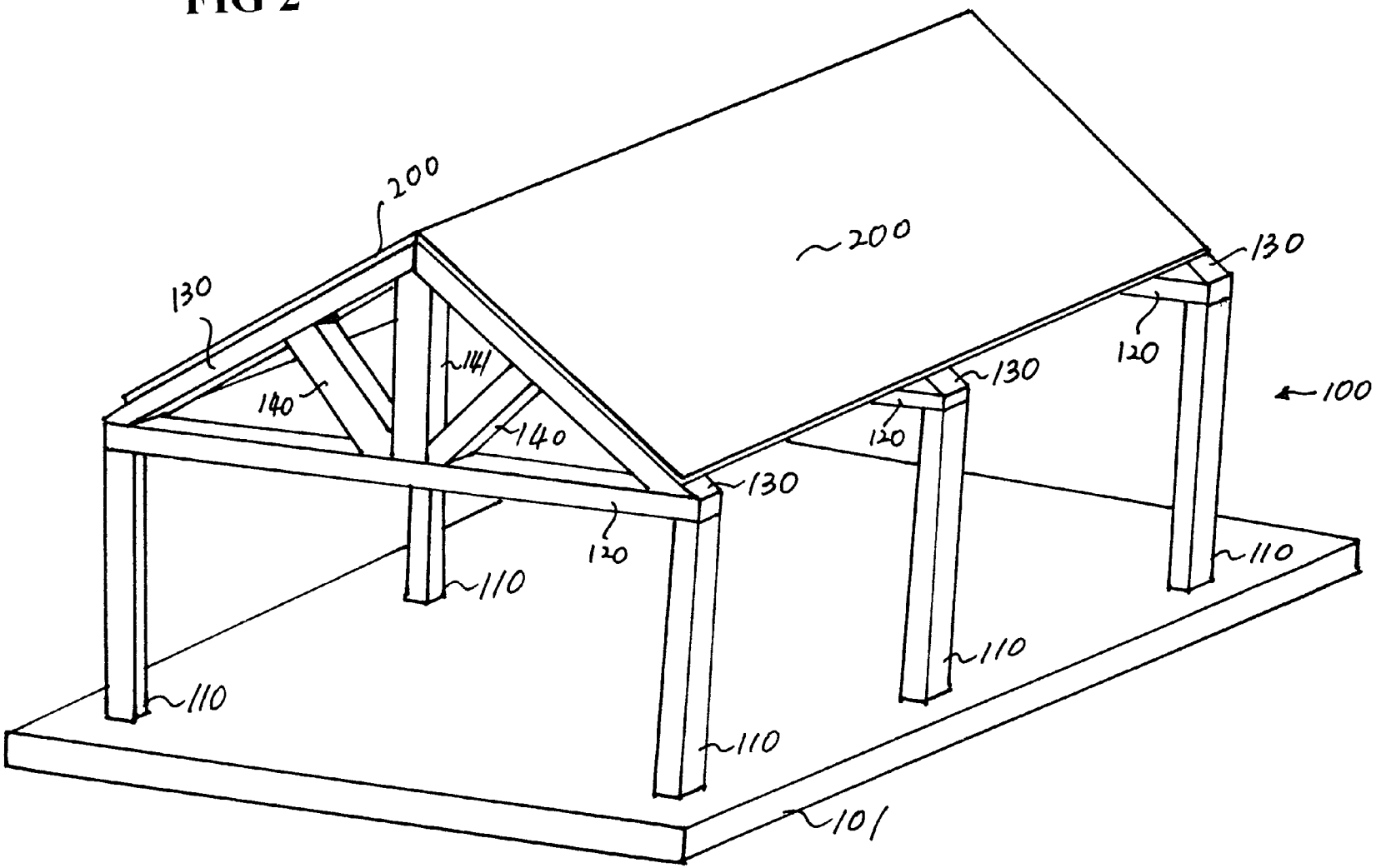
FIG. 2 is a side view of the housing frame structure and a deck covering top beams of the housing form structure.
Figure 3A:
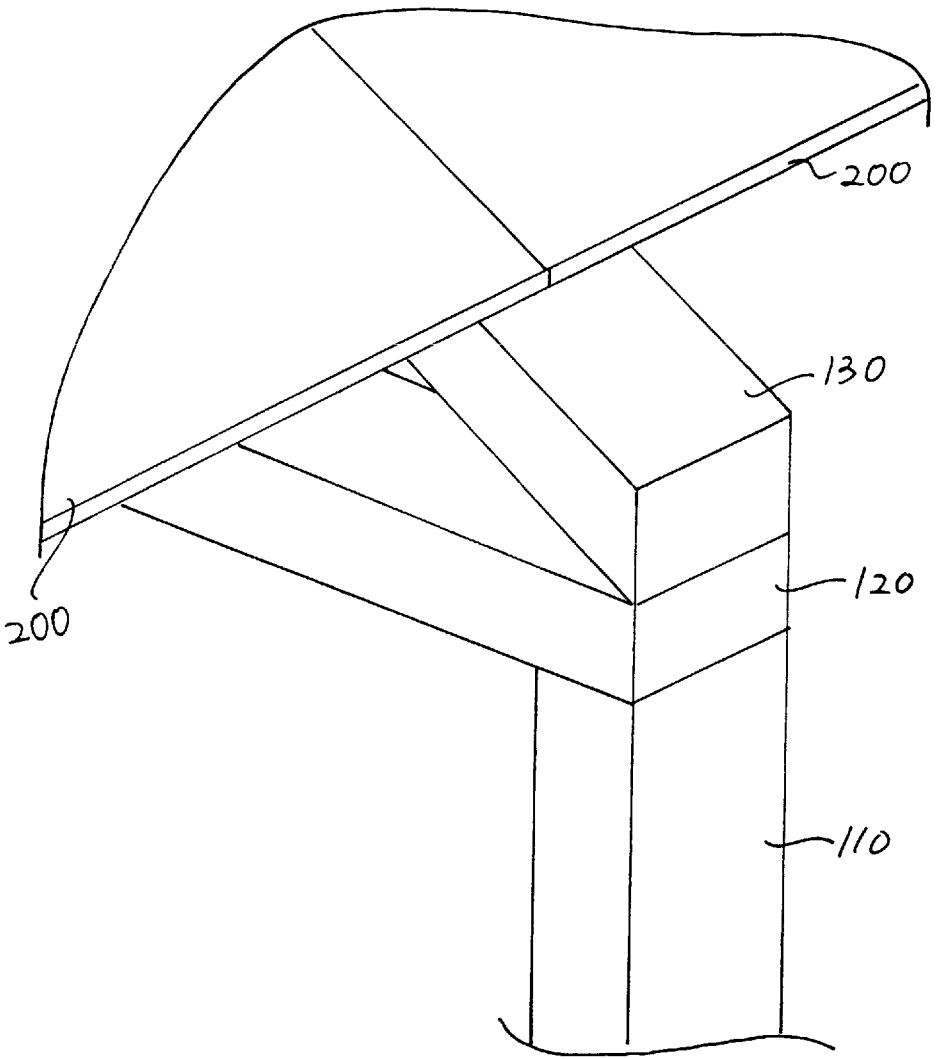
FIGS. 3A and 3B are partial perspective views of the housing frame structure of FIG. 1 to show rectangular beams or H shaped steel beams, respectively.
Figure 3B:
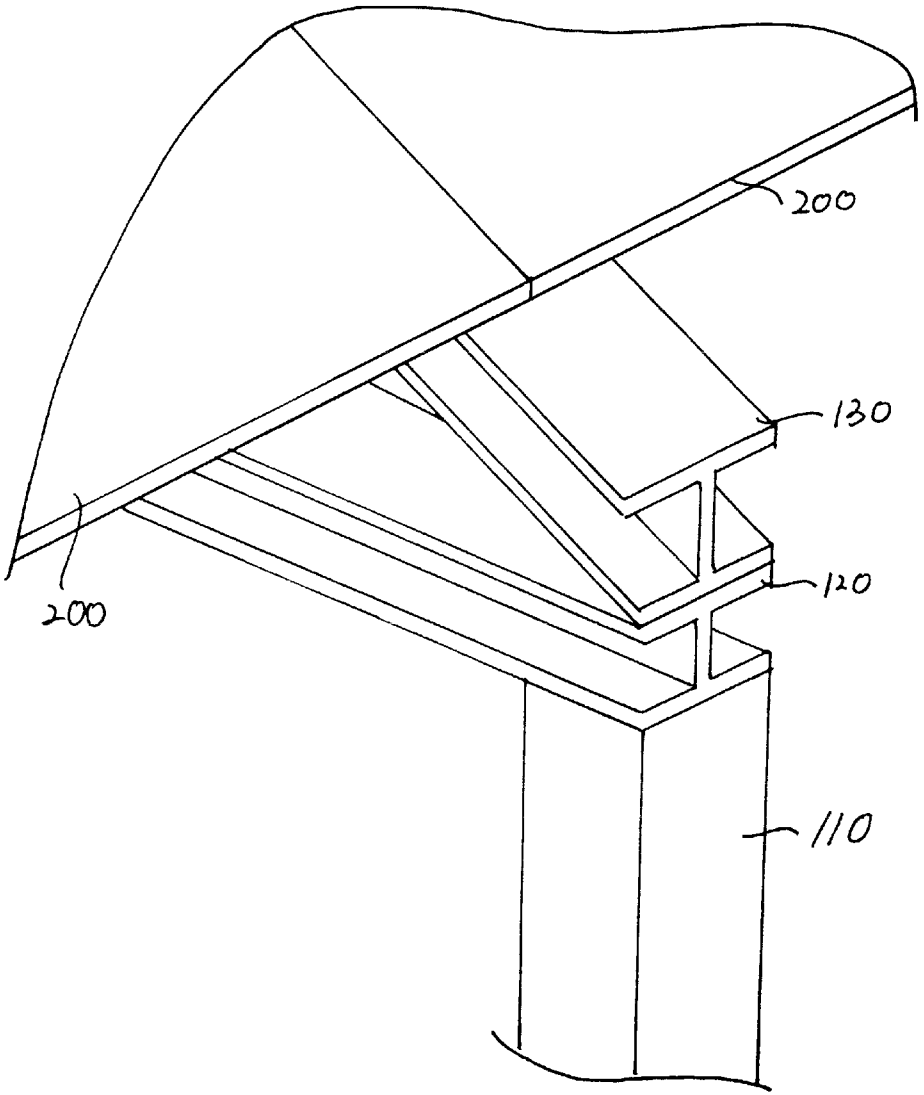

A plurality of auxiliary members 140, 141 are placed between two sloped top beams 130 and horizontal beam 120 to support sloped top beams 130 raised from horizontal beam 120. Although rectangular beams, such as concrete blocks or trusses with steel beam, are used for each beams of the upright structure of housing frame 100 as shown in FIG. 3A, "H" shaped steel beams or "I" shaped steel beams may be used for top beams 130, horizontal beams 120, and columns 110 as shown in FIG. 3B. A plurality of roof decks 200 are secured to top beams 130 to form a roof formwork for forming a roof slab of the monolithic roof structure as shown in FIG. 2. Lower ends of top beams 130 may not be covered by roof decks 200 but may be exposed from roof decks 200.

Figure 4:
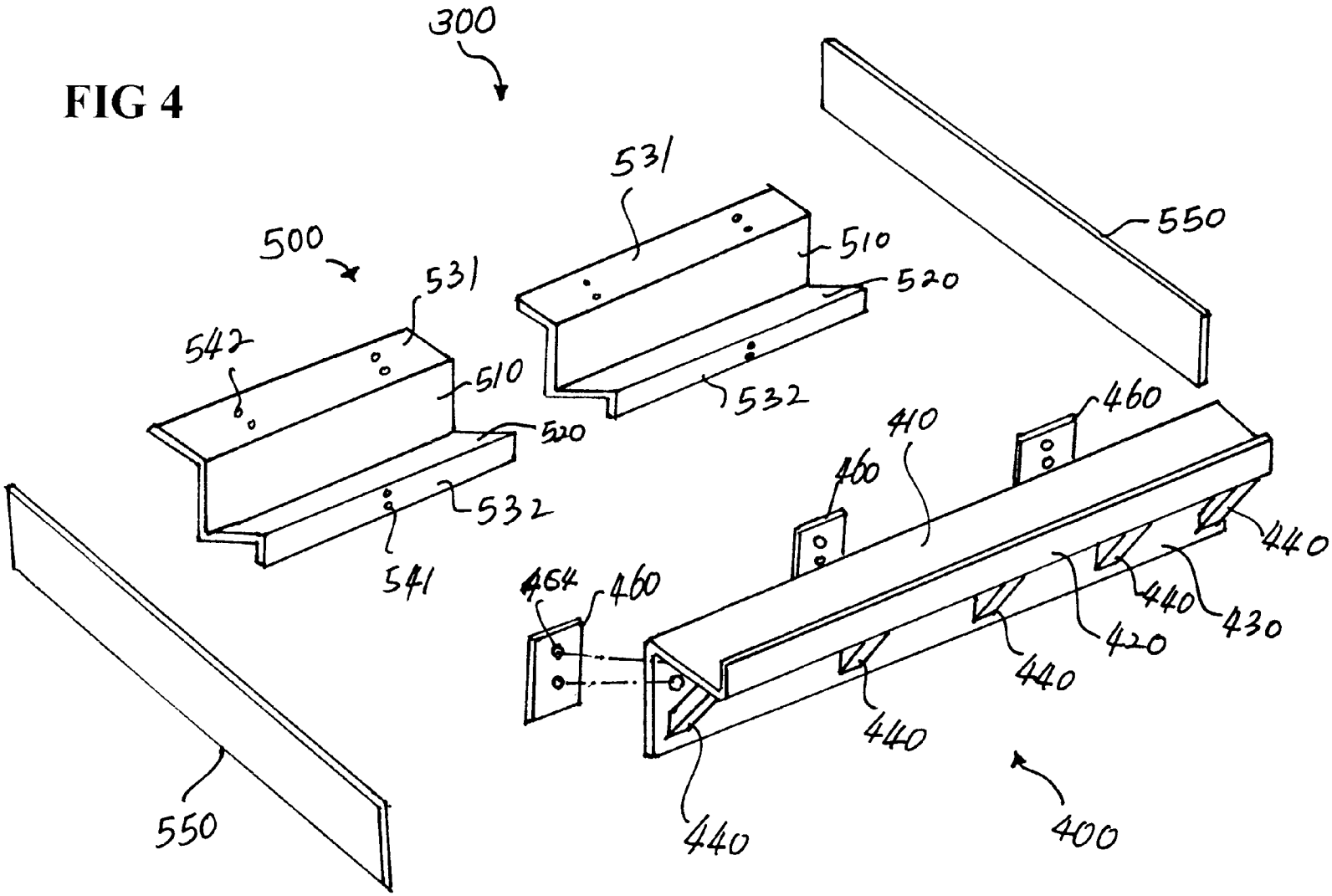
FIG. 4 is a perspective view of a form assembly constructed according to the principle of the present invention.

FIG. 4 shows a form assembly 300 constructed according to the principle of the present invention. Form assembly 300 is provided with an eave formwork 400, a plurality of peripheral formwork 500, and side plates 550. Roof decks 200 are included in form assembly 300 as a roof formwork for forming a roof slab on the roof deck. Eave formwork 400 is provided with an eave panel 410 for supporting an overhanging of the eave extended from the roof slab, an end panel 420 upwardly extended from a longitudinal side of eave panel 410 for forming an end of the overhanging of the eave, a beam coupler 430 downwardly extended from a longitudinal opposite side of eave panel 410 and attached to a vertical outer side of columns 110, a plurality of eave supports 440 disposed between eave panel 410 and beam coupler 430 to support eave panel 410 of eave formwork 400 during pouring the concrete onto eave panel 410 of form assembly 300.

Peripheral formwork 500 includes a vertical panel 510, a horizontal panel 520 horizontally extended from a longitudinal lower side of vertical panel 510, a lower coupler 532 downwardly extended from horizontal panel 520 and coupled to an inner surface of beam coupler 430 of eave formwork 400 and a vertical inner side of column 110, and an upper coupler 531 obliquely upwardly extended from an upper side of vertical panel 510 and coupled to a bottom of roof deck 200. Holes 542 and 541 are provided for coupling peripheral formwork 500 to the bottom of roof deck 200 and one of the inner surface of beam coupler 430 and the vertical inner side of column 110. If lower coupler 532 is coupled to the vertical inner side of column 110, a portion of horizontal panel 520 disposed between columns 110 protrudes by a thickness of horizontal beam 120 toward the inner surface of beam coupler 430 in order to support the peripheral beam formed between horizontal beams 120. Therefore, both sides of lower coupler 532 may be coupled to the vertical inner side of column 110 while the portion of lower coupler 532 is coupled to the inner surface of beam coupler 430. A rectangular longitudinal space is provided by vertical panel 510, horizontal panel 520, and a portion of the inner surface of beam coupler 430 for forming the longitudinal peripheral beam which is one of major features of the present invention when lower coupler 532 and upper coupler 531 are coupled to beam coupler 430 of eave formwork 400 and the bottom of roof deck 200, respectively. A plurality of side plates 550 having a predetermined height are disposed to be attached to each side portion of top beams 130 and roof deck 200. The thickness of the roof slab depends on the height of the side plates.

Figure 5:
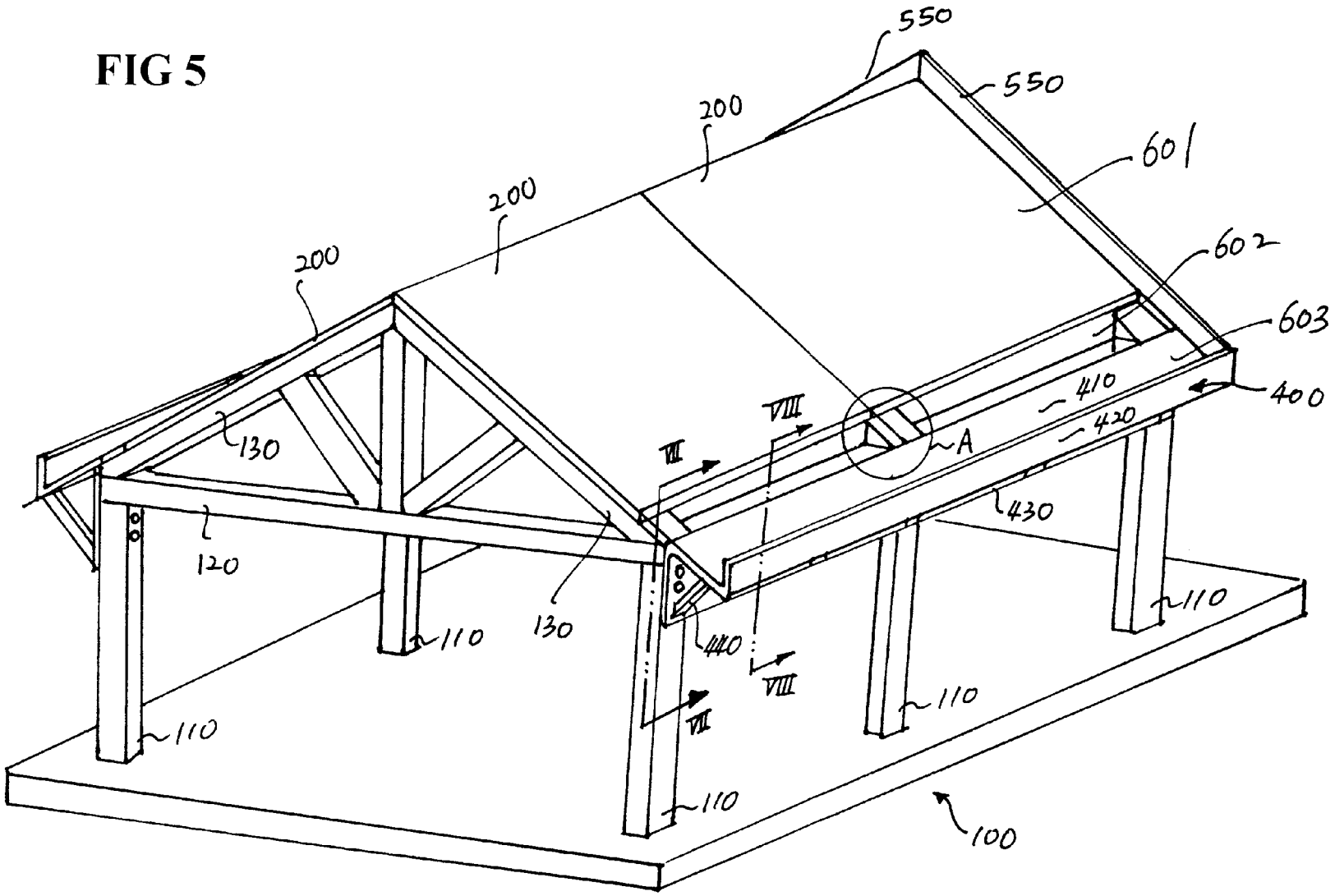
FIG. 5 is a perspective view showing a form assembly mounted on a housing frame structure for forming a roof with an eave and a peripheral beam in a monolithic structure.

FIG. 5 shows form assembly 300 mounted on housing frame structure 100. Each peripheral formwork is disposed between two top beams 130 and between two horizontal beams 110 to be attached to beam coupler 430 of eave formwork 400. A first space 601 for pouring the concrete to form a roof slab is provided by roof deck 200 and side pates 550, and a second space 602 for pouring the concrete to form the longitudinal peripheral beam is provided by peripheral formwork 500 and beam coupler 430 of cave formwork. A third space 603 for pouring the concrete to form the overhanging of the eave is provide by eave portion 410 and end portion 420 of eave formwork 400. The monolithic roof structure having the roof slab, the eave, and the peripheral beam is made by a single concrete pouring operation into spaces 601,602, and 603 through holes formed on covers 700 or gaps formed between covers 700.

Figure 6A:
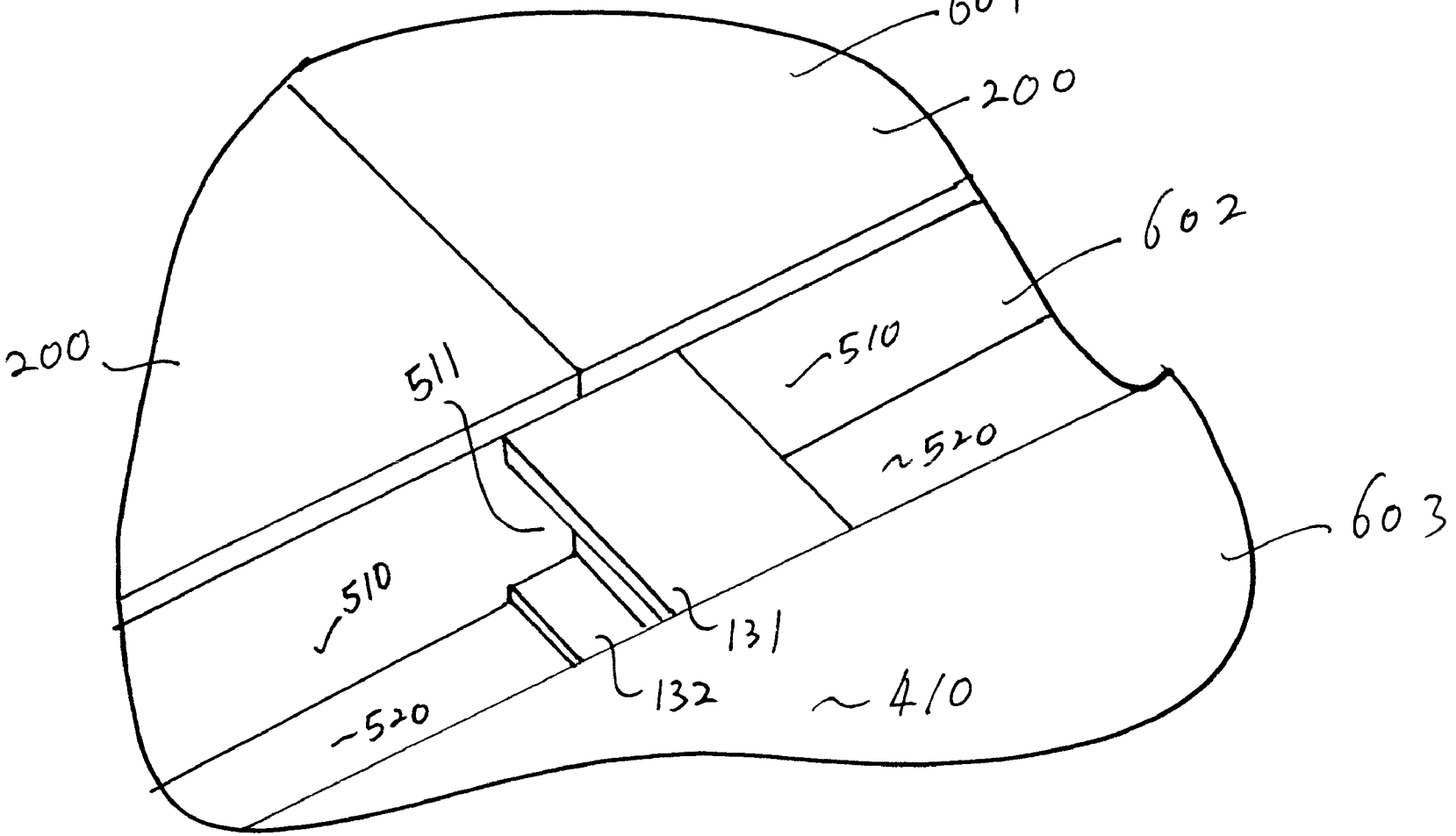
FIGS. 6A and 6B are partial perspective views showing a portion A of FIG. 5.
Figure 6B:
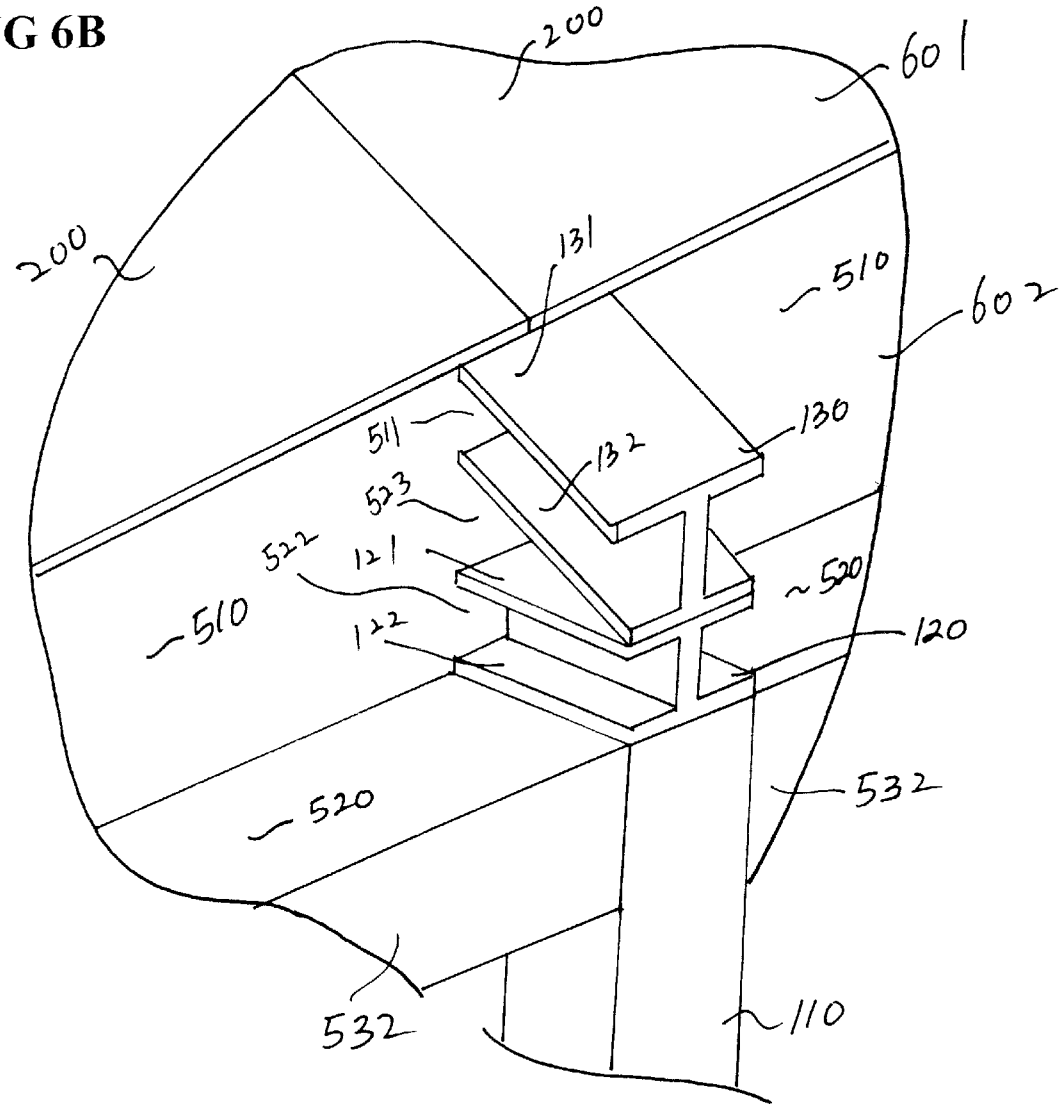

FIGS. 6A and 6B show enlarged housing frame structures of "A" portion of FIG. 5. A "H" shaped steel beam used for top beam 130 as shown in FIG. 6A. Vertical plate 510 and horizontal plate 520 of peripheral formwork 500 are modified to have a shape corresponding to the shape of "H" shaped steel beam 130. A protrusion 511 of vertical plate 510 of peripheral formwork 500 is inserted between two extensions 131, 132 of top beam 130 in order to prevent leakage of the concrete between vertical plate 510 and "H" shaped beam 130 when the concrete is poured into space 602 for the peripheral beam.

If space 602 is provided to include an end portion of horizontal beam 120, vertical panel 510 is modified to form a second protrusion 522 inserted between two extensions 121, 122 of horizontal beam 120. Vertical plate 510 is provided with an extension 523 to cover between end portions of horizontal beam 120 and top beam 130. If the concrete is poured into space 602 as shown in FIG. 6B, the peripheral beam formed within space 602 encloses end portions of horizontal beam 120 and top beam 130. Lower coupler 532 protrudes toward beam coupler 430 in line with the vertical outer surface of column 110 while horizontal plate 520 is placed on the same plane as a top surface of column 110 to support the peripheral beam formed in space 602 as shown in FIG. 6B.

Figure 7A:
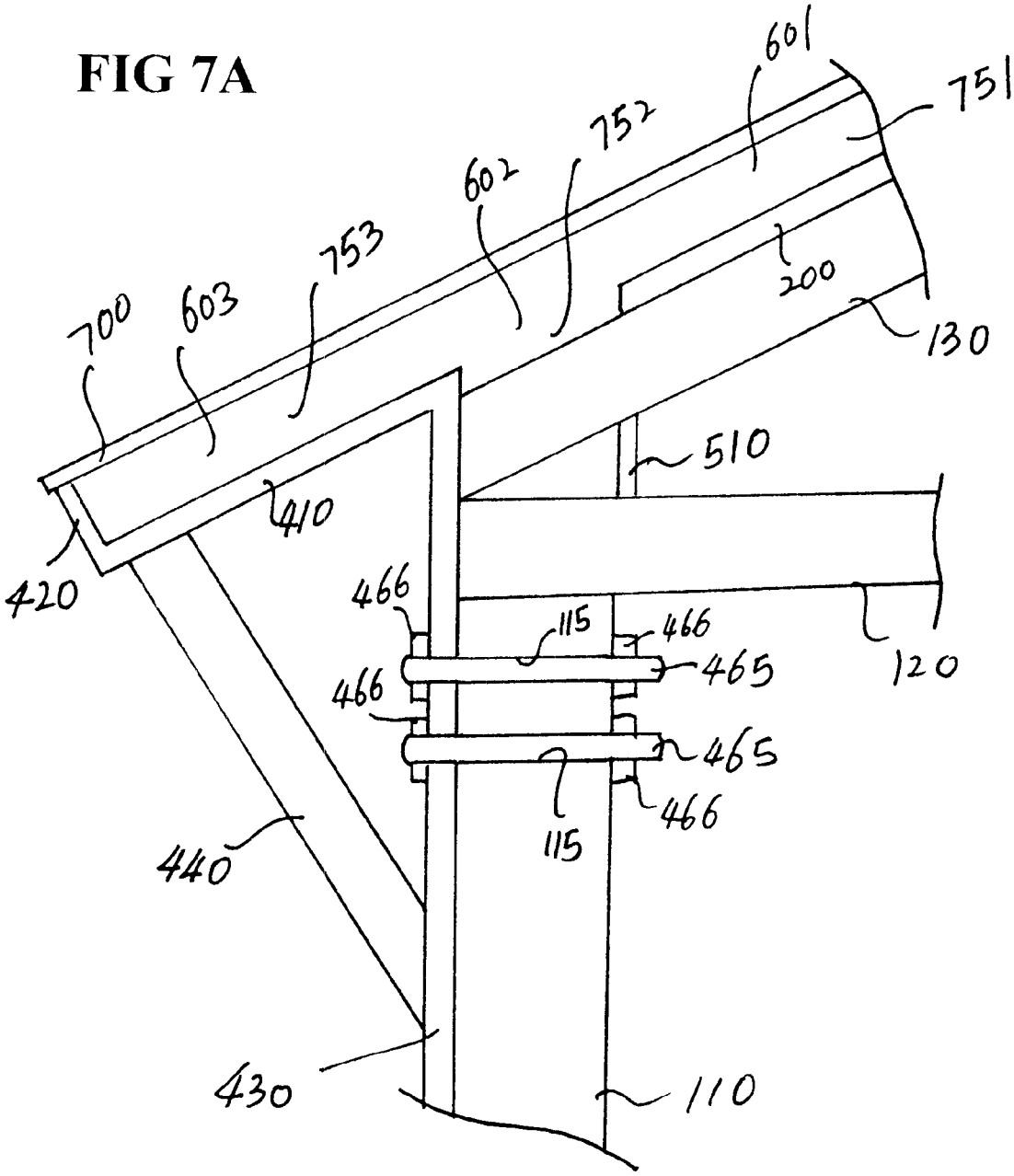
FIGS. 7A and 7B are partial sectional views along lines VII–VII' of FIG. 5.
Figure 7B:
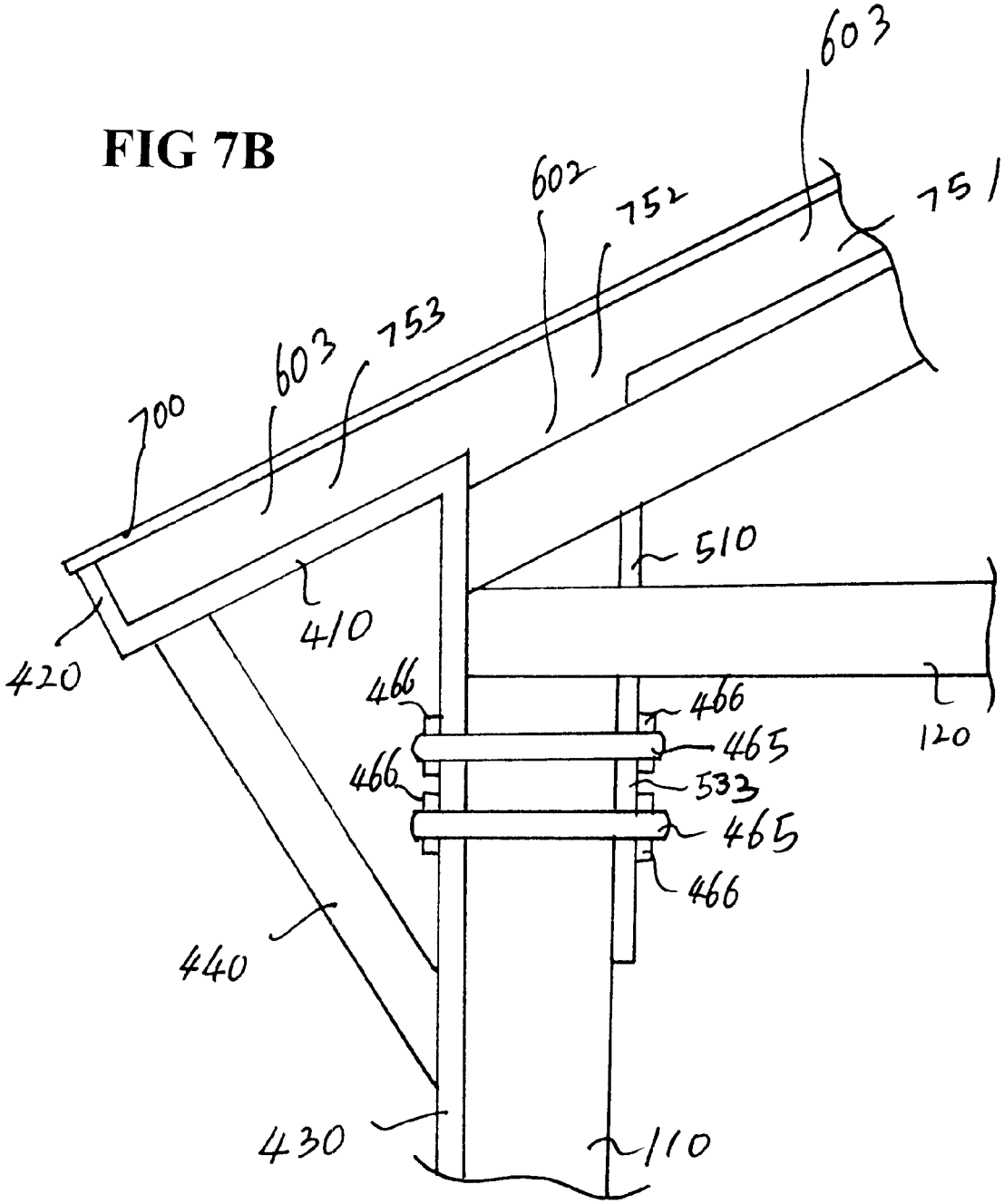

FIGS. 7A and 7B are partial cross sectional views along lines VII–VII' of FIG. 5 to show form assembly 300 attached to column 110. A threaded bolts 465 couples beam coupler 430 to column 110 by inserted into a hole 115 formed on column 110 and by coupled with nuts 466. A plurality of covers 700 are attached to end portion 420 of eave formwork 400 and side plates 550 and is provided to define the spaces 601, 602, 603 with roof deck 200, peripheral formwork 500, eave formwork 400, and side plates 550 for the roof slab, the peripheral beam, the eave, respectively. The concrete may be poured into the spaces 601, 602, 603 through holes formed on the covers 700 or a gap between the covers 700.

The lower end of top beam 130 and one end of horizontal beam 120 is enclosed in the peripheral beam of the monolithic structure. The peripheral beam 752 is supported by column 110 because peripheral beam 752 contains the end portion of horizontal beam 120 which rests on an upper surface of column 110. A roof slab 751 formed between roof deck 200 and cover 700 is supported by roof deck 200 while eave 753 formed with peripheral beam 752 and roof slab 751 in a monolithic structure is supported by both roof slab 751 and peripheral beam 752. In FIG. 7B, a lower extension 533 is downwardly extended from vertical panel 510 to be coupled to column 110 by threaded bolts 465 while horizontal panel 520 is horizontally extended from vertical panel 510 to support the concrete poured into space 602 for forming the peripheral beam. A separate additional peripheral formwork may be provided to be attached to the inner surface of column 110 and the bottom of roof deck 200 in order to provide a portion of space 602, which contains the end portions of horizontal beam 120 and top beam 130, when peripheral formwork 500 is disposed only between columns 110 and is coupled to beam coupler 430 and roof deck 200.

Figure 8:
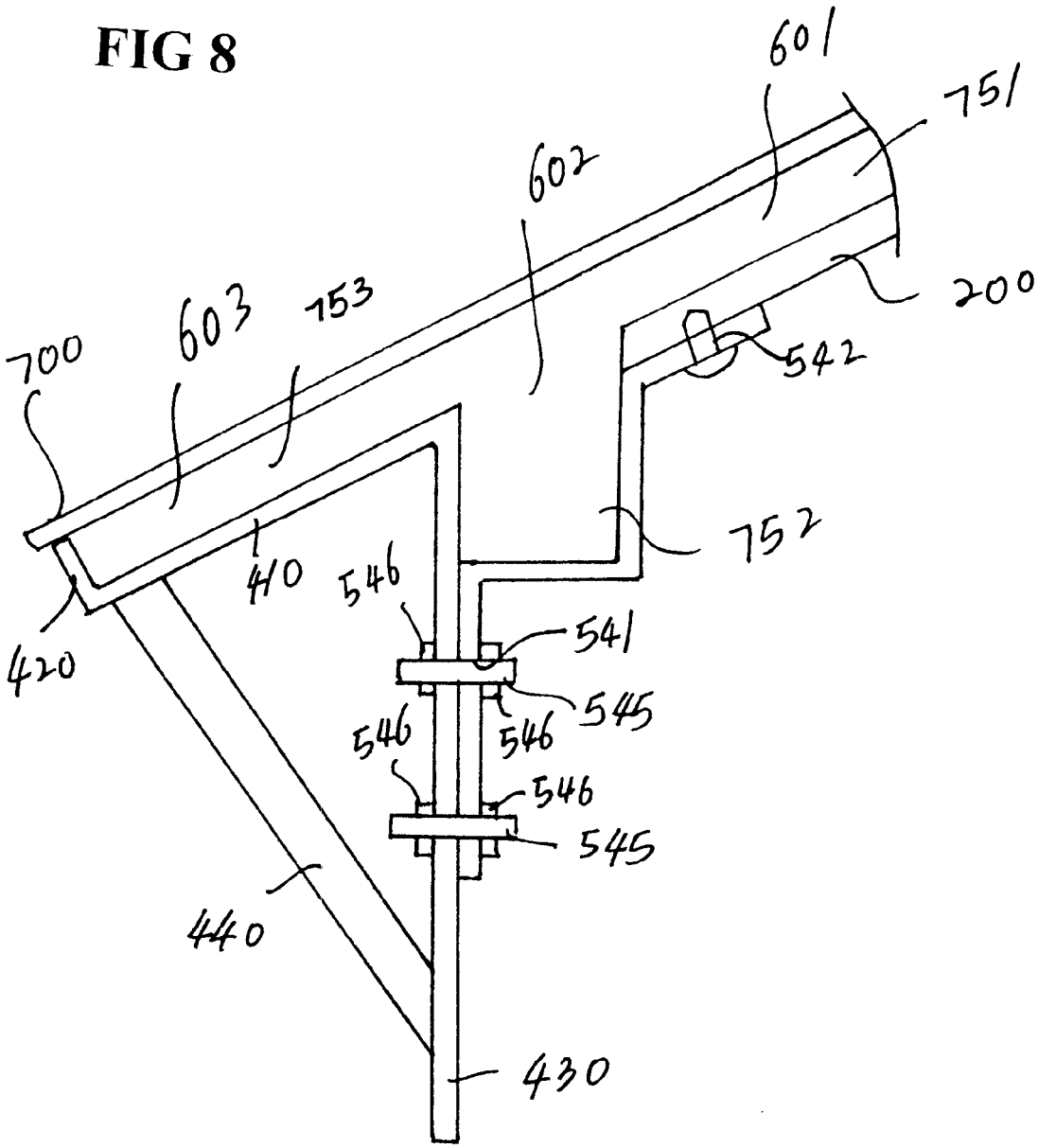
FIG. 8 is a partial sectional view along lines VIII–VIII' of FIG. 5.

FIG. 8 is a partial sectional view along lines VIII–VIII' of FIG. 5 to show peripheral formwork 500 attached to beam coupler 430 of eave formwork 400. The space 602 for peripheral beam disposed between horizontal beam 120 does not enclose the lower end of top beam 130 and one end of horizontal beam 120.

Figure 9:
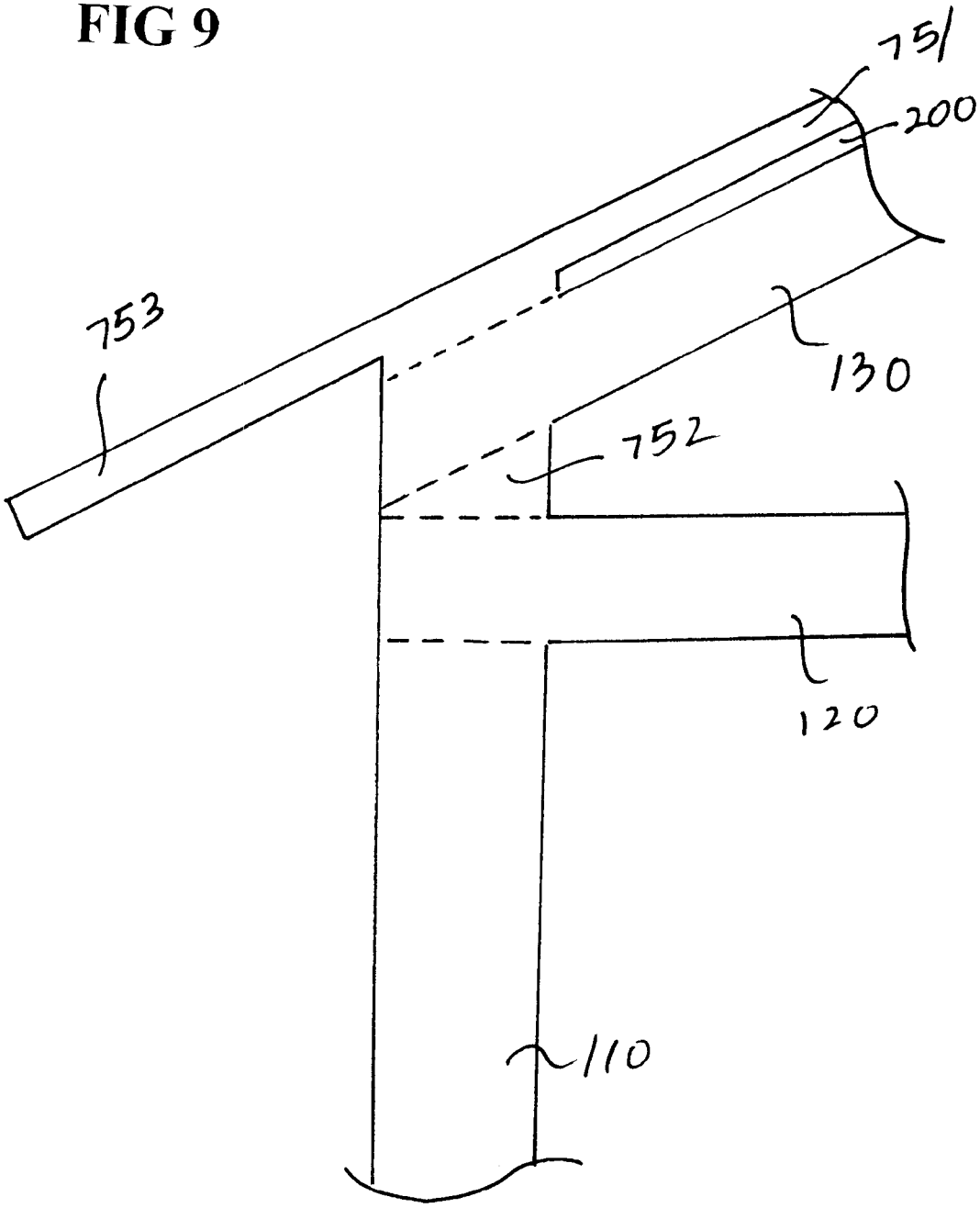
FIG. 9 is a partial view of the monolithic structure of FIG. 7.
Figure 10:
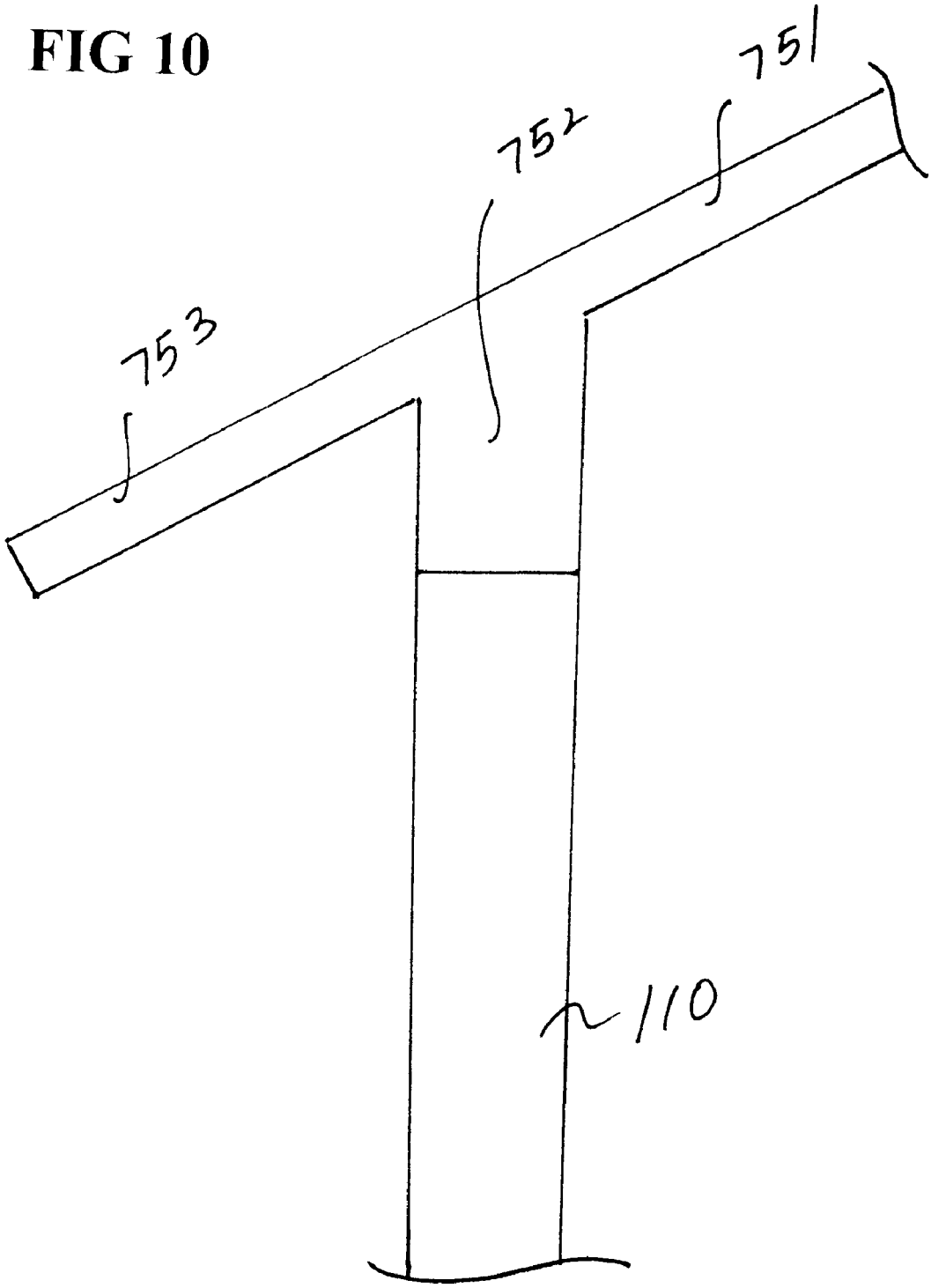
FIG. 10 is a partial view of the monolithic structure of FIG. 8.

After the concrete is poured into the spaces 601, 602, 603 for forming roof slab 751, peripheral beam 752, and eave 753 and is set, eave formwork 400, peripheral formwork 500, side plates 550, and cover 700 are removed from housing frame structure 100 while roof deck 200 is remained to be formed in a monolithic roof structure 750 with roof slab 751, peripheral beam 752, and eave 753. FIG. 9 is a partial cross sectional view of monolithic roof structure 750 of FIG. 7. A bottom of peripheral beam 752 rests on the top surface of columns 110 of housing frame structure 100. Since peripheral beam 752 encloses each end of horizontal beam 120 and top beam 130, the monolithic roof structure becomes stronger. FIG. 10 shows a partial cross sectional view of the monolithic roof structure 750 between horizontal beams 120.

If roof slab 751 and eave beam 753 have a height enough to support eave beam 753 extended from roof beam 751, peripheral beam 752 may be not formed between eave beam 753 and roof slab 751 by attaching eave formwork 400 directly to both column 110 and roof deck 200 while roof deck 200 covers up to the end of top beams 130. Space 602 does not exist because beam coupler 430 of eave formwork 400 is disposed adjacent to roof deck 200.

As mentioned above, with the form assembly having an eave formwork, a peripheral beam formwork, and side plates constructed by the principle of the present invention, a roof slab is formed with an eave and a peripheral beam in a monolithic structure. Since the peripheral beam encloses one end of a top beam and rests on columns, the overall strength of the monolithic structure increases.

Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. A form assembly adapted to be attached to a housing frame having pairs of upright columns spaced-apart from each other, a horizontal beam having two ends resting on top surfaces of each pair of columns, and top beams placed on the horizontal beam, said form assembly comprising:

a roof deck placed on said top beams and adapted to be used for forming a roof slab;

an eave formwork adapted to be used for forming an eave, said eave formwork including an eave panel, a beam coupler downwardly extended from one end of said eave panel and adapted to be coupled to outer sides of said columns, and an end panel upwardly extended from another end of said eave panel; and a peripheral formwork adapted to be used for forming a peripheral beam disposed between said roof slab and said eave, said peripheral formwork disposed between said roof deck and said column, said peripheral formwork including a first panel, a second panel horizontally extended from one end of said first panel, a lower coupling panel downwardly extended from said second panel and adapted to be coupled to said columns, and an upper coupling panel upwardly extended from another end of said first panel and adapted to be coupled to said roof deck.

2. The form assembly of claim 1, wherein said roof slab, said eave, and said peripheral beam are made in a monolithic structure.

3. The form assembly of claim 1, with said eave formwork made of a single plate.

4. The form assembly of claim 1, with said peripheral formwork made of a single plate.

5. The form assembly of claim 1, with said first panel of said peripheral farmwork being spaced-apart from said beam coupler of said eave formwork.

6. The form assembly of claim 1, with said first panel of said peripheral farmwork being parallel to said beam coupler of said eave formwork.

7. The form assembly of claim 1, with said second panel disposed between said first panel and said beam coupler of said eave formwork.

8. The form assembly of claim 1, with said second panel being spaced-apart from a plane connected between said roof deck and said eave panel of said eave formwork.

9. The form assembly of claim 1, said upper coupling panel being attached to one of said columns.

10. The form assembly of claim 1, with said eave panel being parallel to said roof deck.

11. The form assembly of claim 1, with said eave formwork including a support coupled between said eave panel and said beam coupler.

12. The form assembly of claim 1, further comprising a plurality of side plates having a rectangular shape and adapted to be coupled one of said roof deck and said top beams, said side plates each coupled to one of said end panel and one side end of said eave panel.

13. The form assembly of claim 12, with said side plates protruding from said plane of said roof deck by a predetermined distance same as the height of said end panel of said eave formwork.

14. The form assembly of claim 12, further comprising a plurality of covers attached to said side plates and said end panel of said eave formwork.

15. The form assembly of claim 14, with said covers having at least one hole.

16. The form assembly of claim 14, with said covers being spaced-apart from said roof deck and said eave panel.

17. The form assembly of claim 1, with said peripheral beam containing any one of end portions of said horizontal beam and said top beam.

18. The form assembly of claim 1, with said peripheral beam resting on said top surface of said columns.

19. A form assembly adapted to be attached to a housing frame having pairs of upright columns spaced-apart from each other, a horizontal beam having two ends resting on top surfaces of each pair of columns, and top beams placed on the horizontal beam, said form assembly comprising:

a roof deck placed on said top beams and adapted to be used for forming a roof slab, said roof deck serving as a lower boundary for said roof slab, said roof deck being permanently attached to said roof slab upon formation of said roof slab;

an eave formwork adapted to be used for forming an eave, said eave formwork including an eave panel, a beam coupler downwardly extended from one end of said eave panel and adapted to be coupled to outer sides of said columns, and an end panel upwardly extended from another end of said eave formwork further comprising an eave support attached to a bottom surface of a distal end of said eave panel to said beam coupler providing support for a distal end of said eave when concrete is poured to form said eave, said eave support connected to said eave panel only at said distal end of said eave panel and not to any other portion of said eave panel.

20. The form assembly of claim 19, said roof deck not being lubricated prior to pouring concrete to form said roof slab so that when said roof slab hardens, said roof deck is permanently attached to said roof slab.

21. The form assembly of claim 19, said top beams being sloped with respect to said horizontal beams, causing said roof deck and said roof slab to be sloped.

22. The form assembly of claim 19, said form assembly being absent any removable formwork from within said housing frame that must be removed after solidification of poured concrete that forms the roof slab and the eave as a single monolithic unit.

23. The form assembly of claim 19, only said eave formwork is removed after solidification of poured concrete that forms the roof slab and the eave as a single monolithic unit.

24. The form assembly of claim 19, wherein said roof slab and said eave are formed prior to formation of walls between said columns.

25. A process for building a house having a housing frame having pairs of upright columns spaced-apart from each other, horizontal beams each having two ends resting on top surfaces of each pair of said columns, and top beams placed on one of said horizontal beams, said process comprising the steps of:

providing an eave formwork adapted to be used for forming an eave, said eave formwork including an eave panel, a beam coupler downwardly extended from one end of said eave panel and adapted to be coupled to outer sides of said columns, and an end panel upwardly extended from another end of said eave panel; and providing a peripheral formwork adapted to be used for forming a peripheral beam disposed between said roof slab and said eave, said peripheral formwork disposed between said roof deck and said column, said peripheral formwork including a first panel, a second panel horizontally extended from one end of said first panel, a lower coupling panel downwardly extended from said second panel and adapted to be coupled to said columns, and an upper coupling panel upwardly extended from another end of said first panel and adapted to be coupled to said roof deck.

26. The process of claim 25, further comprising of the steps of:

attaching a roof deck to upper sides of said top beams;

providing a first space above said roof deck for forming said roof slab, a second space between said peripheral formwork and said eave formwork for forming said peripheral beam, and a third space above said eave panel of said eave formwork for forming said eave; and pouring a concrete material into said first space, said second space, and said third space.

27. The process of claim 25, further comprising of the step of forming said roof slab, said peripheral beam, and said eave in a monolithic structure.

* * * * *